US008634277B2

(12) United States Patent
Hoch et al.

(10) Patent No.: US 8,634,277 B2
(45) Date of Patent: Jan. 21, 2014

(54) ELECTRONIC PERPETUAL CALENDAR WITH ERASABLE AND TACKABLE SURFACES

(75) Inventors: Benjamin Hoch, Irvine, CA (US); Michael Cerillo, San Clemente, CA (US)

(73) Assignee: MEGA Brands International, SARL, Zug (CH)

( * ) Notice: Subject to any disclaimer, the term of this patent is extended or adjusted under 35 U.S.C. 154(b) by 382 days.

(21) Appl. No.: 13/070,695

(22) Filed: Mar. 24, 2011

(65) Prior Publication Data

US 2011/0235468 A1 Sep. 29, 2011

Related U.S. Application Data

(60) Provisional application No. 61/317,405, filed on Mar. 25, 2010.

(51) Int. Cl.
*G04C 17/00* (2006.01)
*G04B 47/00* (2006.01)

(52) U.S. Cl.
USPC ..... 368/29; 368/41; 40/107

(58) Field of Classification Search
USPC ..... 368/41–44, 28–30, 223–224; 434/407–408, 413; 40/107
See application file for complete search history.

(56) References Cited

U.S. PATENT DOCUMENTS

| | | | | |
|---|---|---|---|---|
| 1,042,337 | A | 10/1912 | Gorin | |
| 1,459,236 | A | 6/1923 | Orth | |
| D69,773 | S | 3/1926 | Rosenblum | |
| 1,951,325 | A | 3/1934 | Brett | |
| 2,319,278 | A | 5/1943 | Urbain | |
| D164,008 | S | 7/1951 | Loyd | |
| D208,051 | S | 7/1967 | Bott | |
| 3,916,172 | A | 10/1975 | Engle, Jr. | |
| D244,017 | S | 4/1977 | Bott | |
| D244,771 | S | 6/1977 | Bott | |
| D271,011 | S | 10/1983 | Bott | |
| 4,648,189 | A | 3/1987 | Michel | |
| 4,708,490 | A | 11/1987 | Arber | |
| D300,642 | S | 4/1989 | Pawlik et al. | |
| D312,923 | S | 12/1990 | Bleazard | |
| D317,400 | S | 6/1991 | Loew | |
| D333,607 | S | 3/1993 | Isler | |
| 5,199,009 | A * | 3/1993 | Svast | 368/240 |
| D343,865 | S | 2/1994 | Pohl | |
| 5,301,477 | A | 4/1994 | Rellinger et al. | |
| D358,037 | S | 5/1995 | Monroe | |
| 5,527,568 | A | 6/1996 | Boone et al. | |
| 5,655,323 | A | 8/1997 | Lassoff | |
| 5,658,635 | A | 8/1997 | Davis et al. | |
| D384,821 | S | 10/1997 | Sugar | |

(Continued)

*Primary Examiner* — Sean Kayes
(74) *Attorney, Agent, or Firm* — Plumsea Law Group, LLC

(57) ABSTRACT

An electronic perpetual calendar erasable board with a tackable surface, such as a bulletin bar. In one embodiment, the calendar may include a front panel having a graphic that includes cells each representing a calendar day, e.g., a month grid of cells arranged in rows and columns or a weekly planner table with cells arranged in a row. The front panel may include a plurality of electronic displays so that the calendar is capable of displaying an accurate number and configuration of days for any month or week. Other embodiments may include a markable and erasable write-on/wipe-off surface and a frame that has a tackable surface integrated therein. The tackable surface may be cork, foam, fiber, or a composite.

30 Claims, 16 Drawing Sheets

(56) References Cited

U.S. PATENT DOCUMENTS

| | | | | |
|---|---|---|---|---|
| D393,001 | S | 3/1998 | Mayo | |
| D396,350 | S | 7/1998 | Panzenhagen | |
| D398,783 | S | 9/1998 | Plein, II | |
| D402,696 | S | 12/1998 | Rosen | |
| D402,697 | S | 12/1998 | Rosen | |
| D410,250 | S | 5/1999 | Robertson, Jr. | |
| 5,928,756 | A | 7/1999 | Davis et al. | |
| 5,948,498 | A | 9/1999 | Bianco et al. | |
| 5,976,663 | A | 11/1999 | Davis et al. | |
| 5,987,825 | A | 11/1999 | Rosen | |
| D433,573 | S | 11/2000 | Rochon | |
| D465,522 | S | 11/2002 | Beno | |
| D478,348 | S * | 8/2003 | Gladd et al. | D19/21 |
| D480,221 | S | 10/2003 | Luciano | |
| 6,631,573 | B1 | 10/2003 | Alba | |
| 6,657,924 | B2 | 12/2003 | Mccravy | |
| D496,068 | S | 9/2004 | Mandel | |
| 6,837,715 | B2 | 1/2005 | Beno | |
| 6,877,262 | B2 | 4/2005 | Bianco | |
| D515,969 | S | 2/2006 | Hines | |
| D521,557 | S | 5/2006 | Fedorov et al. | |
| 7,093,857 | B2 | 8/2006 | Martin | |
| 7,260,904 | B1 | 8/2007 | Boisseau | |
| 7,293,993 | B2 | 11/2007 | Fedorov et al. | |
| D562,589 | S | 2/2008 | Mellon | |
| 7,376,909 | B1 | 5/2008 | Coyle | |
| 7,480,212 | B1 | 1/2009 | DuBreuil | |
| D590,018 | S | 4/2009 | Nash et al. | |
| D593,156 | S | 5/2009 | Vasconcelos | |
| D602,487 | S | 10/2009 | Maskatia | |
| D609,782 | S | 2/2010 | Whatley | |
| D610,104 | S | 2/2010 | Yamaguchi et al. | |
| D610,354 | S | 2/2010 | Kuo | |
| D615,512 | S | 5/2010 | Yamaguchi et al. | |
| D623,226 | S | 9/2010 | Hoch et al. | |
| D623,227 | S | 9/2010 | Hoch et al. | |
| D623,228 | S | 9/2010 | Hoch et al. | |
| D623,693 | S | 9/2010 | Hoch et al. | |
| 2001/0036127 | A1* | 11/2001 | McCravy | 368/28 |
| 2002/0160352 | A1* | 10/2002 | Beno | 434/408 |
| 2005/0022439 | A1* | 2/2005 | Crump | 40/711 |
| 2005/0066560 | A1* | 3/2005 | Ternovits et al. | 40/606.19 |
| 2005/0071984 | A1* | 4/2005 | Beno | 29/527.3 |
| 2005/0191611 | A1 | 9/2005 | Owen et al. | |
| 2005/0255272 | A1 | 11/2005 | Query | |
| 2007/0077815 | A1* | 4/2007 | White et al. | 439/607 |
| 2007/0217292 | A1 | 9/2007 | Williams | |
| 2007/0287140 | A1* | 12/2007 | Liebowitz | 434/304 |
| 2008/0104868 | A1 | 5/2008 | Drie | |
| 2008/0263917 | A1 | 10/2008 | Kwon | |
| 2009/0029338 | A1* | 1/2009 | Kang | 434/430 |
| 2012/0021400 | A1* | 1/2012 | Tai | 434/413 |

* cited by examiner

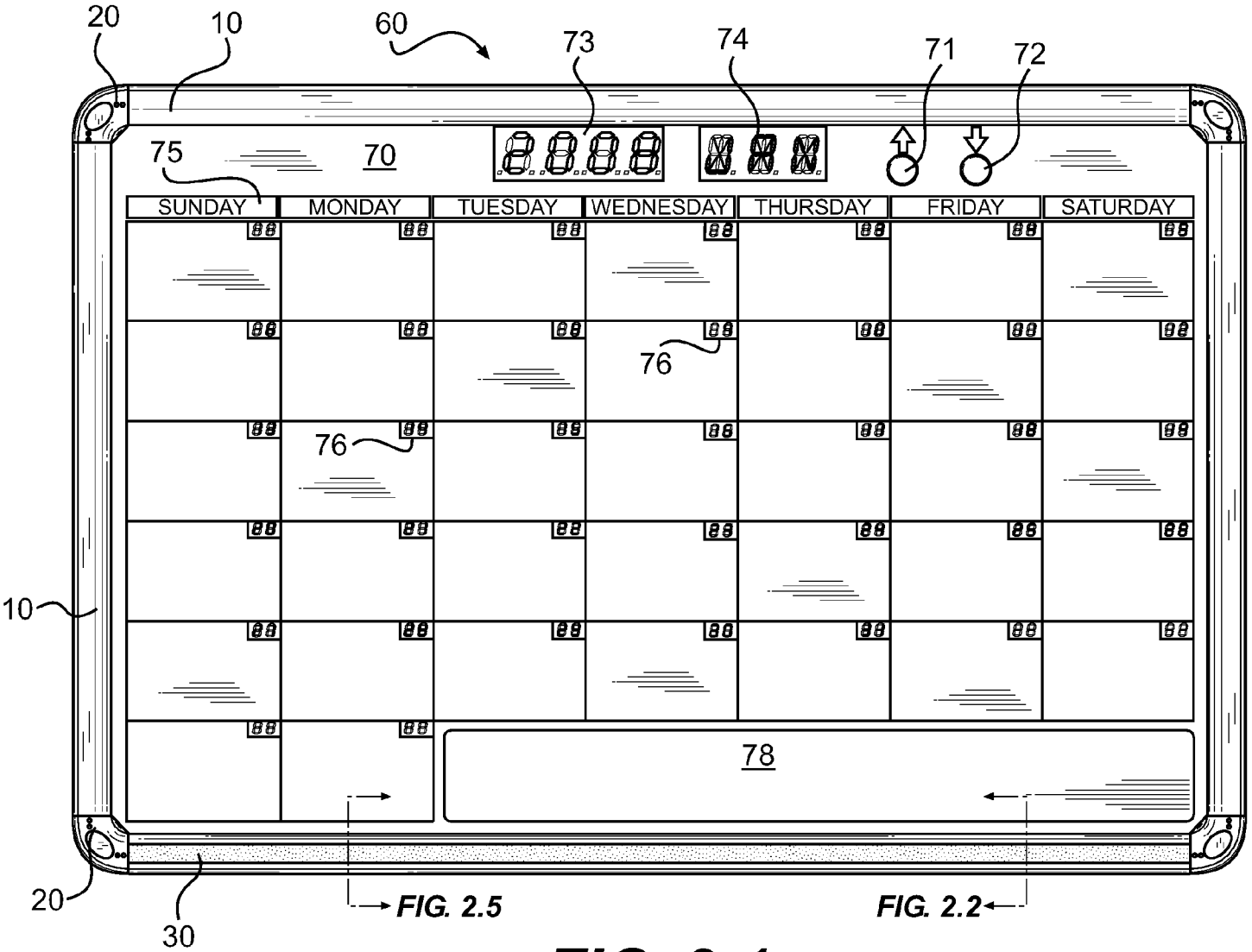
FIG. 2.1

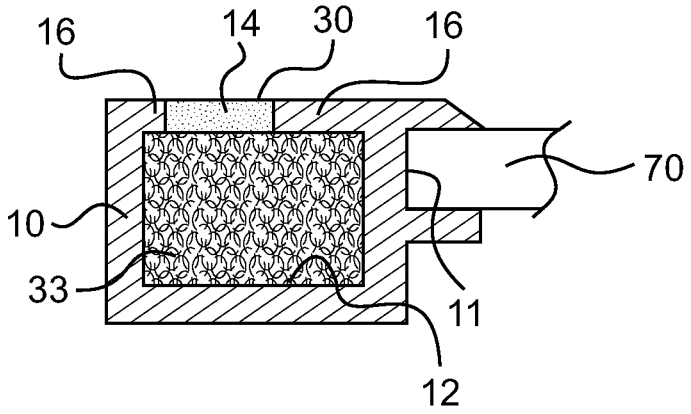
FIG. 2.2
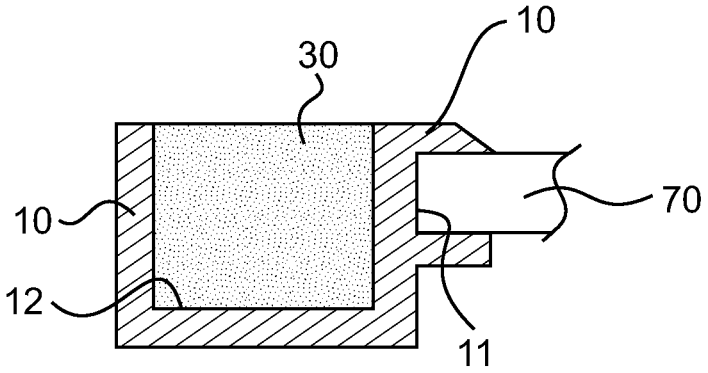
FIG. 2.3

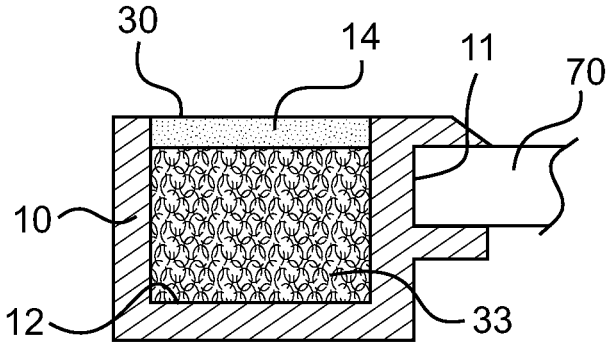
FIG. 2.4
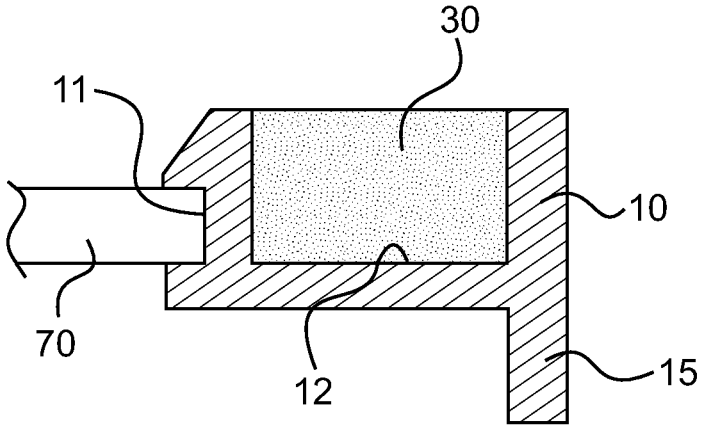
FIG. 2.5

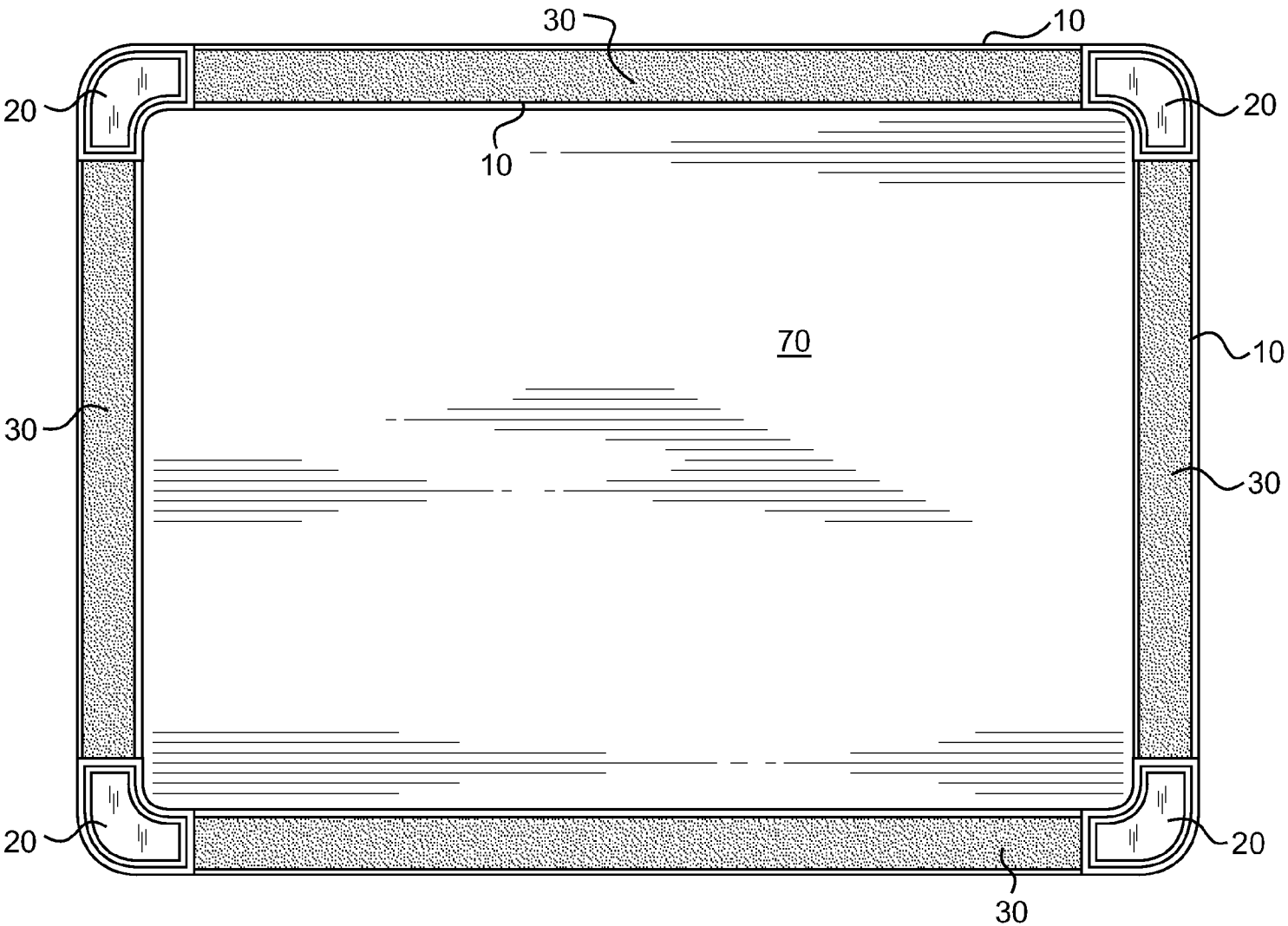
FIG. 2.6

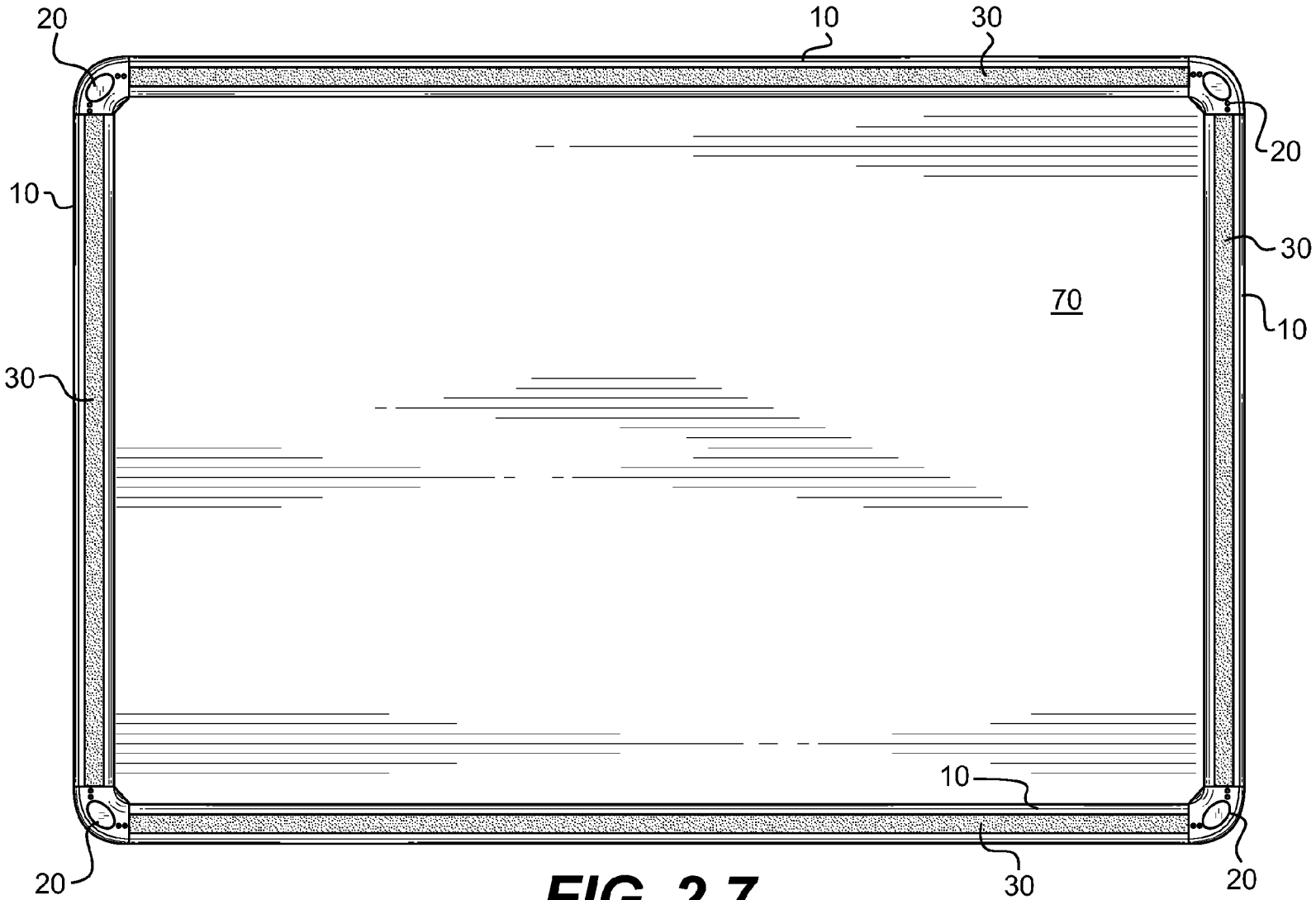
FIG. 2.7

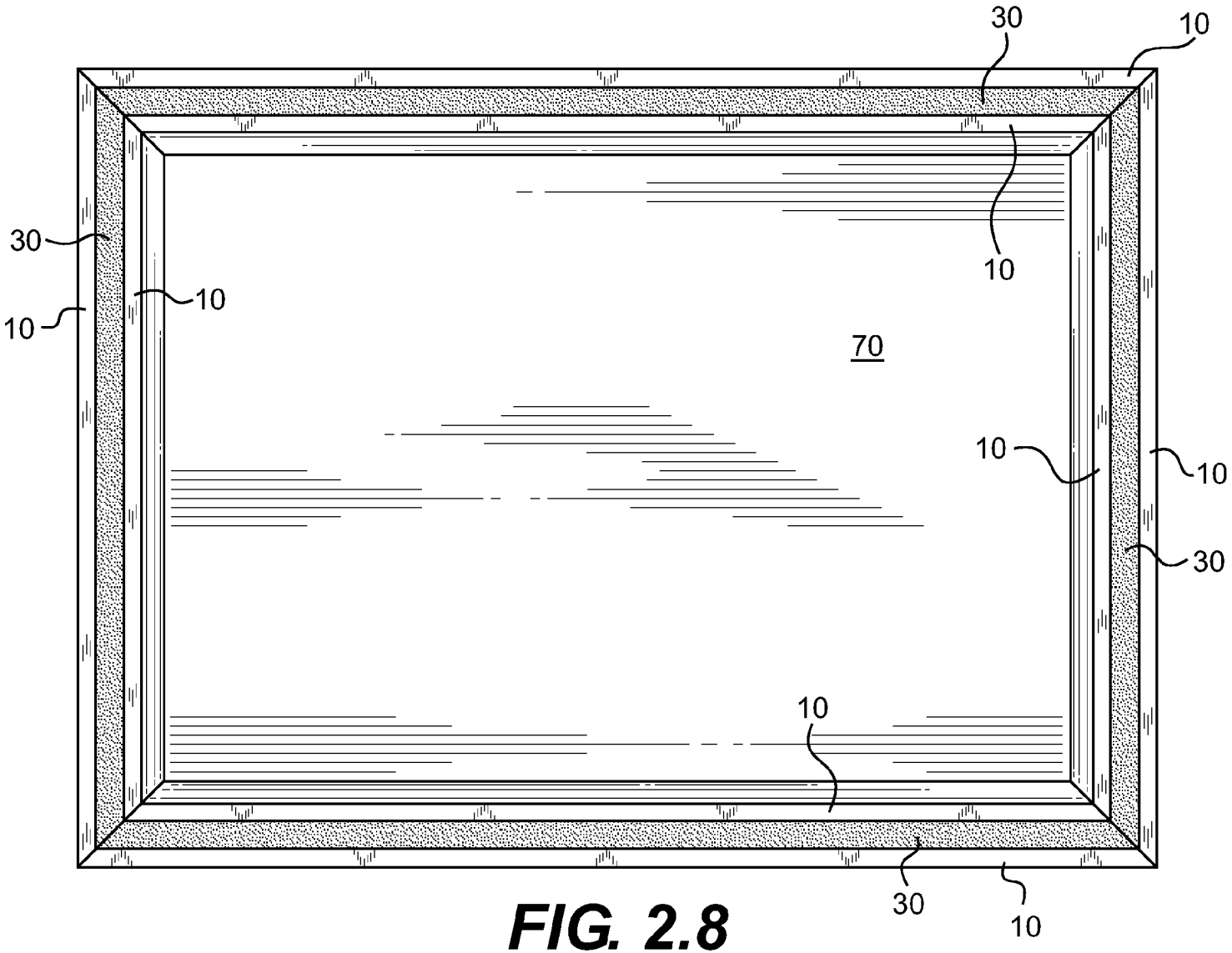
FIG. 2.8

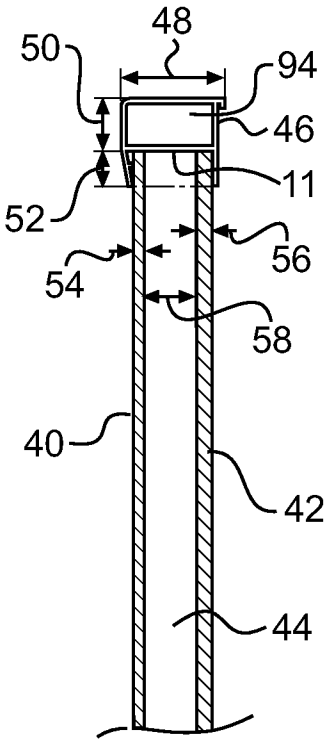
FIG. 10.2
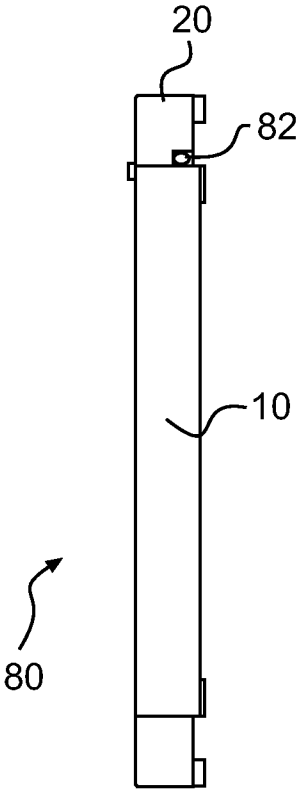
FIG. 10.1

ELECTRONIC PERPETUAL CALENDAR WITH ERASABLE AND TACKABLE SURFACES

This application claims the benefit of U.S. Provisional patent application No. 61/317,405, filed Mar. 25, 2010, which is herein incorporated by reference in its entirety.

BACKGROUND OF THE INVENTION

1. Field of the Invention

This invention relates to display boards and, more particularly, to display boards that may be used to display calendars, removably tacked-on materials, and erasable writings or other markings.

2. Description of Related Art

Dry erase boards and tackable display boards are known. Known boards have a tackable surface, such as cork or fiber and a markable surface, such as melamine, porcelain coated paper, metal, or film. The tackable surface preferably permits a note or display to be attached to the board by a push pin or thumb tack, and preferably the pin or tack may be removed to permit mounting of another note or display. Preferably, markings on the markable surface may be erased with an eraser or wiped with a cloth, to permit other markings to be made on the markable surface. Examples of known dry erase boards and tackable display boards are described in prior art patents, including U.S. Pat. No. 5,527,568 to Boone et al.; U.S. Pat. No. 5,655,323 to Lassoff; U.S. Pat. No. 5,658,635 to Davis et al.; U.S. Pat. No. 5,928,756 to Davis et al.; U.S. Pat. No. 5,948,498 to Bianco; U.S. Pat. No. 5,976,663 to Davis et al.; and U.S. Pat. No. 6,837,715 to Beno.

U.S. Pat. No. 7,260,904 discloses a wall calendar system. The wall calendar system includes several separate sections, including a marker board, a cork board, a paper calendar that is pivotally mounted to the wall calendar system, and a file pouch located on the back of each month of the paper calendar so that the various important papers and business cards may be stored until needed.

The use of dry erase boards as calendars is known. U.S. Pat. No. 6,877,262 describes a perpetual calendar that may include a write-on/wipe-off surface. As noted in that patent, monthly calendars are typically constructed with at least twelve sheets of paper with a single month in one particular year displayed on each sheet. Because the first weekday in each month varies monthly and yearly, each sheet of such a calendar is typically obsolete after the particular month has ended, and a user must display a separate sheet to accurately convey the current month. Likewise, an entire calendar is typically obsolete after the particular year has ended, and a user must discard the entire calendar and replace it with a calendar displaying the accurate configuration of days for the current year.

To counter this problem, several "perpetual calendars" have been invented that allow a single calendar to be reused to display multiple months of multiple years with the appropriate starting weekday. U.S. Pat. No. 1,042,337 to Gorin describes a web or ribbon that is horizontally movable behind an opaque glass front. The web or ribbon includes dates of a month arranged in columns or series so that when it is horizontally displaced, an opening in the glass front exposes the consecutive numbers 1-31 beginning on any weekday of the month. When the month has ended, a button of the last day of the month is pressed, and the web or ribbon is displaced to expose the days of the next month as beginning on the day after the weekday of the button pressed.

U.S. Pat. No. 1,459,236 to Orth describes a perpetual calendar with adjustable knobs for the year, month, and first day of the week for a given month. The knob for the first day of the week operates by horizontally displacing a web, but serves to display dates only for the upper four weeks of a current month. When turned, a fourth knob vertically displaces a second web to display one of twenty-one horizontal lines representing each of the possible date configurations of the last two weeks of a month.

In a conventional paper calendar, a user may write notes directly onto the calendar pages to ensure that events, such as birthdays or meetings, are remembered on the correct day. Because the month page in a conventional calendar is obsolete at the month's end, the page can merely be torn off and thrown away. However, with the perpetual calendars discussed above, because the month grid is reused, any markings on the grid would be carried on to every month, causing confusion and inaccuracy.

Accordingly, U.S. Pat. No. 6,877,262 discloses an erasable perpetual monthly calendar that includes a front panel with a month grid of cells and weekdays permanently displayed on it. The front panel is capable of displaying an accurate number and configuration of any month. At least one surface, which is coupled to and movable behind the front panel, has numbers permanently printed on it and spaced so that when the at least one surface is moved, an accurate number and configuration of days for any month can be displayed through the windows. An at least semi-transparent sheet is coupled to and in front of the front panel and has a write-on/wipe-off surface.

In another embodiment described in U.S. Pat. No. 6,877,262, a perpetual monthly calendar includes a front panel, a first surface with a first number matrix, and a second surface with a second number matrix. The front panel displays a grid of cells with columns representing weekdays and rows representing the upper rows of a calendar and at least one lower row of a calendar. A window is cut out of the front panel in each cell. The first surface is coupled to the front panel and is horizontally movable behind the upper rows and the second surface is coupled to the front panel and is horizontally movable behind the at least one lower row. In this embodiment, the first number matrix is arranged so that by moving the first surface horizontally in relation to the front panel, a plurality of numbers of the first number matrix is visible through a plurality of windows in the upper rows. The first number matrix is also arranged so that the numbers visible through the windows can accurately represent sequential dates of the upper rows of a calendar for a month starting on any weekday. The second number matrix is arranged so that by moving the second surface horizontally in relation to the front panel, at least one of the numbers in the second number matrix is visible through at least one window in the at least one lower row, and can accurately represent sequential dates for the at least one lower row of a calendar for a month beginning on any weekday and an accurate number of days for any month.

SUMMARY OF THE INVENTION

Aspects of the present invention provide a display board having an electronic perpetual calendar and erasable and tackable surfaces. The surfaces may include a dry erase board and a bulletin bar. In one embodiment, to provide a calendar, a board may include a front panel with a graphic of cells and weekday names permanently displayed on the front panel, e.g., as a month grid or weekly planner table. The front panel may include a plurality of electronic displays so that the calendar may be capable of displaying an accurate number and configuration of days for any month or week. A display board may also include a markable surface dry erase board with a write-on/wipe-off surface and a frame that has a tackable surface (such as cork, foam, fiber, or a composite) integrated therein.

An aspect provides a display board comprising an erasable surface (e.g., a dry erase surface) having a write-on/wipe-off surface, a frame that surrounds the periphery of a display board panel and is secured thereto, and an electronic perpetual calendar. The electronic perpetual calendar may include a graphic permanently printed on the display board, an electronic day display, a year display for displaying a year, a month display for displaying a month, an electronic display control microprocessor, and an interface for controlling the electronic day displays. The displays and microprocessor of the electronic perpetual calendar may be digital. The electronic day display may be provided in an area (e.g., a corner) of each cell in a window of the display board (e.g., a window that is cut out from the panel) such that the electronic day display is visible from a front side of the display board. The erasable surface may be applied to the panel and may preferably be transparent so that the erasable surface may cover the window while the electronic display is still visible through the transparent erasable surface. Alternatively, the erasable surface may be cut out around the windows, such that the electronic day display provides the outer surface. The display control microprocessor may be in communication with each of the electronic day displays so as to control the electronic day displays.

In another aspect, the graphic may comprise a month grid having a plurality of cells arranged in rows and columns.

In another aspect, the graphic may comprise a weekly planner table with the plurality of cells arranged in a row, and the electronic display control microprocessor may control the electronic day displays to display a configuration of dates corresponding to a designated month, week, and year.

In another aspect, the interface may be configured to enable a user to select the designated week, and the electronic perpetual calendar may further comprise a week display for displaying the designated week.

In another aspect, the year display and the month display may be electronic and the interface may be configured to control the day, month, and year displays.

In another aspect, the electronic day displays may be digital two-digit light-emitting diode numerical displays.

In another aspect, the interface for controlling the electronic day displays may comprise a manual control configured to enable a user to select the designated month and year, and the electronic display control microprocessor may automatically control the electronic day displays to accurately display in the plurality of cells the configuration of dates corresponding to the designated month and year.

In another aspect, the interface for controlling the electronic day displays may comprise a plurality of control buttons that directly control the month display via the microprocessor, and the electronic display control microprocessor may automatically control the year and day displays to display the designated year in the year display and to accurately display in the plurality of cells the configuration of dates corresponding to the designated month and year.

In another aspect, the interface for controlling the electronic day displays may be an automatic interface, the display board may include radio clock receiver circuitry that is synchronized by a time code bit stream transmitted by a radio transmitter in communication with a time standard, and the time standard may provide the designated month and year.

In another aspect, the display board may further comprise an additional display for time of day provided by the time standard.

In another aspect, the frame may have a separate tackable surface integrated therein.

In another aspect, the frame may have a separate tackable surface integrated therein along a plurality of sides of the frame or along all sides of the frame.

In another aspect, the tackable surface may be a composite of a surface layer on a supporting layer.

In another aspect, the display board panel may comprise a front panel and a back panel, the frame may define a channel opening towards an interior area defined by the frame, the front panel may be disposed within the channel on a front side of the frame, the back panel may be disposed within the channel on a back side of the frame such that the front panel and the back panel define an open space in between the front panel and the back panel, the electronic display control microprocessor may be disposed within the open space, the erasable surface may be disposed on an outer surface of the front panel and the front panel may have cut-outs defining the windows of the cells, and the electronic day displays may be aligned with the cut-outs of the front panel.

In another aspect, the erasable surface may comprise a continuous transparent layer over the front panel and the cut-outs of the front panel.

In another aspect, the graphic may be printed on a substrate surface of the front panel underneath the transparent layer.

In another aspect, the frame may define a second channel that opens towards a front side of the display board, a tackable surface may be disposed within the second channel, the frame may be made of a first material, and the tackable surface may be made of a second material different from the first material.

In another aspect, the tackable surface may comprise an exposed surface layer and a supporting layer concealed within the second channel and underneath the exposed surface layer.

In another aspect, the frame may define an overhanging portion that overhangs at least a portion of the tackable surface that is within the second channel.

In another aspect, the frame may define a first channel that opens towards an interior area defined by the frame, the frame may define a second channel that opens towards a front side of the display board, the display board panel may be disposed within the first channel, a tackable surface may be disposed within the second channel, the frame may be made of a first material, the tackable material may be made of a second material different from the first material. When viewed in a cross-section taken along a longitudinal direction of a member of the frame, a rear interior surface of the first channel may be approximately aligned with a bottom interior surface of the second channel, and the frame may include a support member extending toward a rear side of the display panel and generally perpendicularly to the bottom interior surface of the second channel, so as to reduce a volume of the second material needed to fill the second channel.

In another aspect, the graphic may further comprise a weekday name displayed adjacent to each group of the plurality of cells representing a same weekday.

Another aspect provides a display board comprising a panel, an erasable surface disposed on the panel and having a write-on/wipe-off surface, and a frame that surrounds the periphery of the panel and is secured thereto, with the frame having a tackable surface integrated therein. The frame may have a tackable surface integrated therein along a plurality of sides of the frame or along all sides of the frame. The tackable surface may be a composite of a surface layer on a supporting layer. The tackable surface may sit within a channel formed in the frame such that, when viewed in a cross-section taken perpendicular to a longitudinal direction of the frame member, the tackable surface is supported on three sides by the frame, with one surface exposed so as to provide a tackable surface that permits a note paper or other item to be attached to the board by a push pin or thumb tack.

Another aspect provides a display board comprising a panel, an erasable surface disposed on the panel and comprising a write-on/wipe-off surface, and a frame that surrounds the periphery of the panel and is secured thereto, with the frame having a tackable surface integrated therein and including a first channel for securing the panel and a second channel for receiving and supporting the tackable surface.

In another aspect, the display board may further comprise an electronic perpetual calendar that includes a month grid permanently printed on the display board. The month grid may comprise a plurality of cells arranged in rows and columns and a weekday name displayed adjacent to each column of the month grid. The display board may comprise an electronic day display provided in an area (e.g., a corner) of each cell in a window, a year display for displaying a year, a month display for displaying a month, an electronic display control microprocessor in communication with each of the electronic day displays so as to control the electronic day displays, and an interface for controlling the electronic day displays. The electronic display control microprocessor may control the electronic day displays to display a configuration of dates corresponding to a designated month and year.

In another aspect, the display board may further comprise an electronic perpetual calendar that includes a weekly planner table permanently printed on the display board. The weekly planner table may comprise a plurality of cells successively arranged adjacent to each other and a weekday name displayed adjacent to each cell. The display board may comprise an electronic day display provided in an area of each cell in a window, a year display for displaying a year, a month display for displaying a month, an electronic display control microprocessor in communication with each of the electronic day displays so as to control the electronic day displays, and an interface for controlling the electronic day displays. The electronic display control microprocessor may control the electronic day displays to display a configuration of dates corresponding to a designated month, week, and year.

In another aspect, the tackable surface may be a composite of a surface layer on a supporting layer.

In another aspect, the frame may be cut from wood or may be extruded.

Other systems, methods, features, and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

FIG. 2.1 is a schematic diagram illustrating a front view of the display board of FIG. 1;

FIG. 2.2 is a schematic diagram illustrating a cross-sectional view of an exemplary frame construction, taken along line 2.2 of FIG. 2.1;

FIG. 2.3 is a schematic diagram illustrating a cross-sectional view of another exemplary frame construction, as an alternative to the construction of FIG. 2.2;

FIG. 2.4 is a schematic diagram illustrating a cross-sectional view of another exemplary frame construction, as an alternative to the construction of FIG. 2.2;

FIG. 2.5 is a schematic diagram illustrating a cross-sectional view of another exemplary frame construction, taken along line 2.5 of FIG. 2.1;

FIG. 2.6 is a schematic diagram illustrating a front view of an embodiment of an alternative display board design;

FIG. 2.7 is a schematic diagram illustrating a front view of another embodiment of an alternative display board design;

FIG. 2.8 is a schematic diagram illustrating a front view of yet another embodiment of an alternative display board design;

FIG. 10.1 is a schematic diagram illustrating a side view of the display board of FIG. 8;

FIG. 10.2 is a schematic diagram illustrating a partial cross-sectional side view of the display board of FIG. 8;

DETAILED DESCRIPTION

Figure 1:
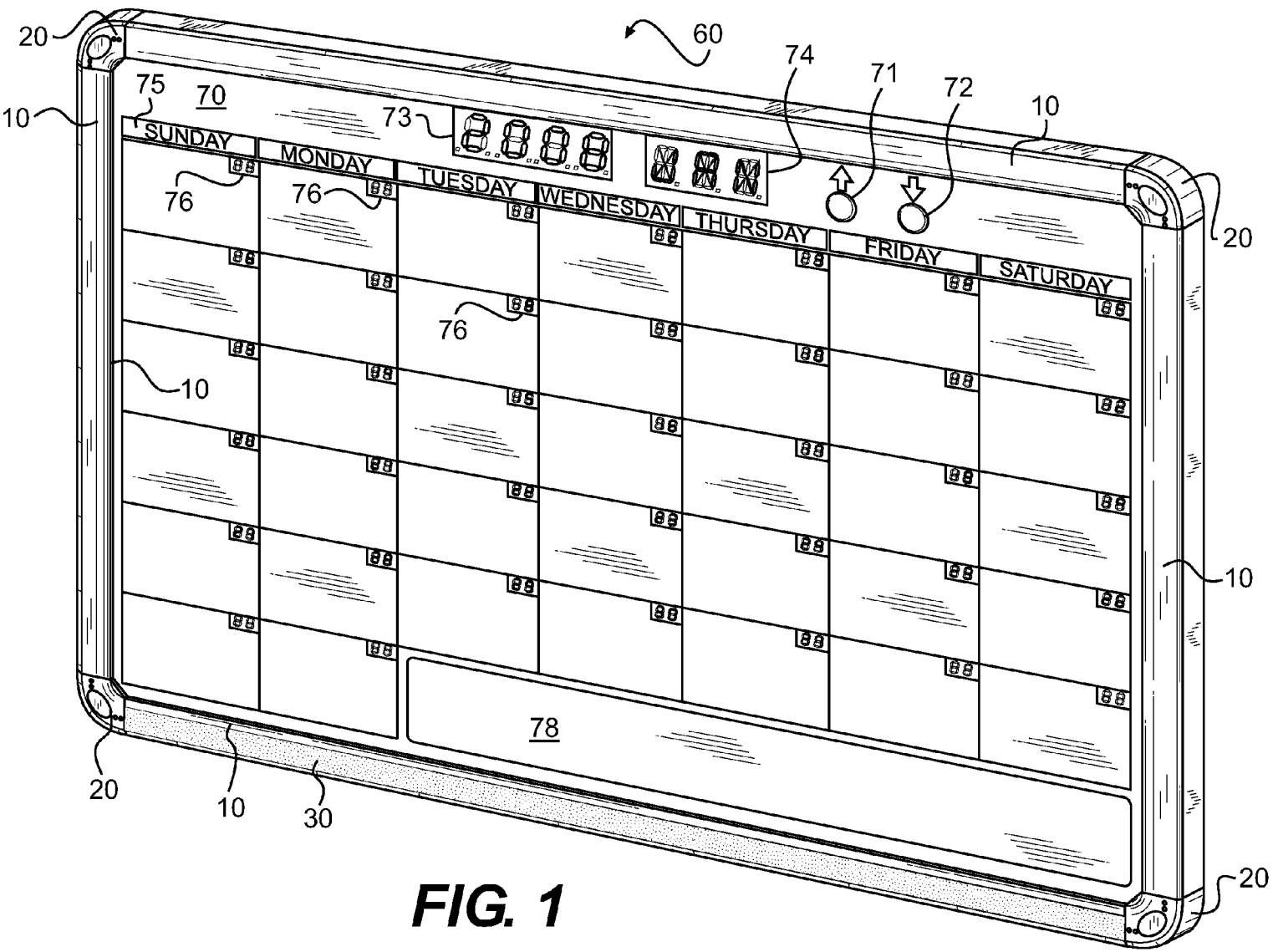
FIG. 1 is a schematic diagram illustrating a perspective view of an embodiment of a display board.
Figure 3:
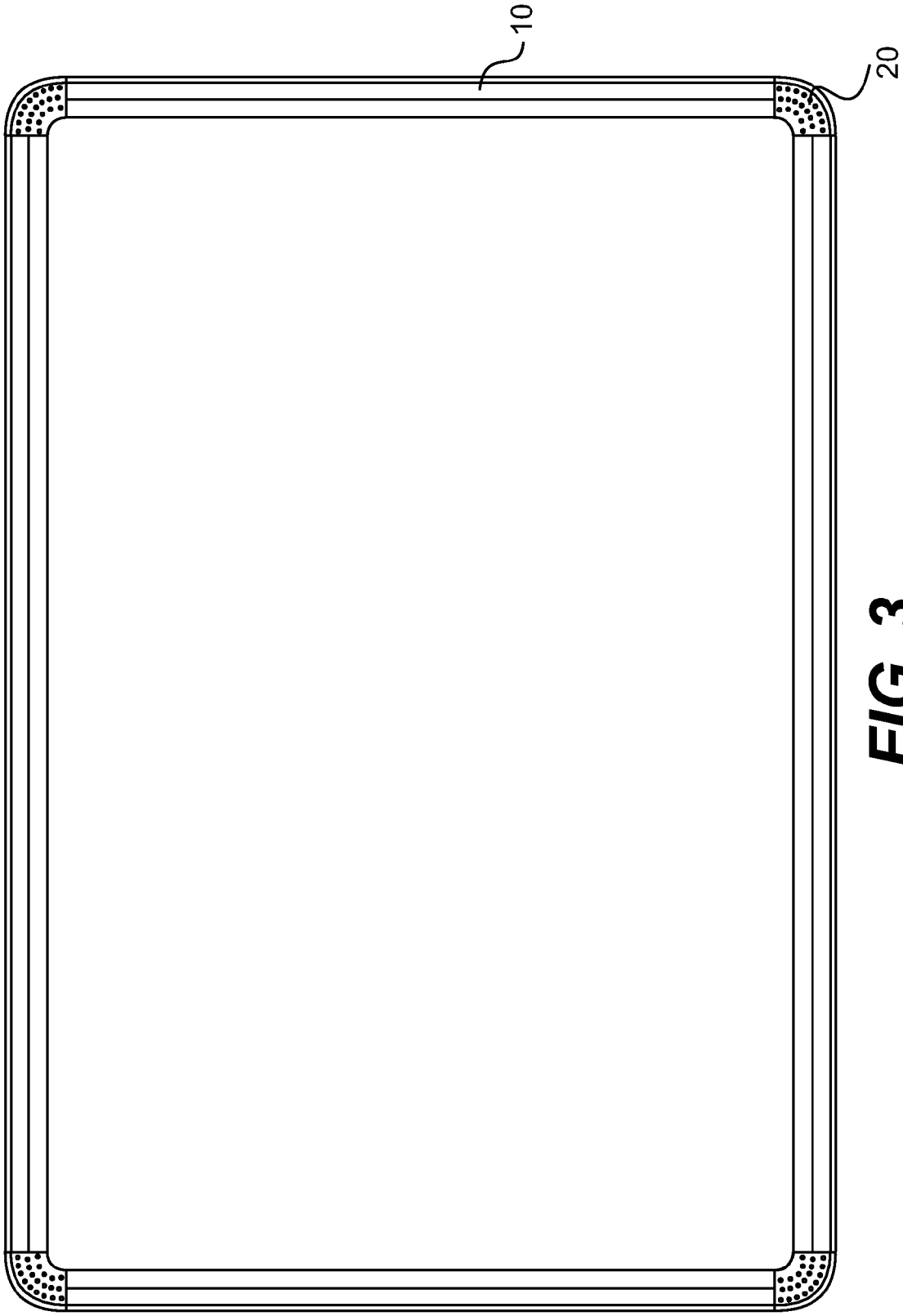
FIG. 3 is a schematic diagram illustrating an unornamented rear view of the display board of FIG. 1.
Figure 5:
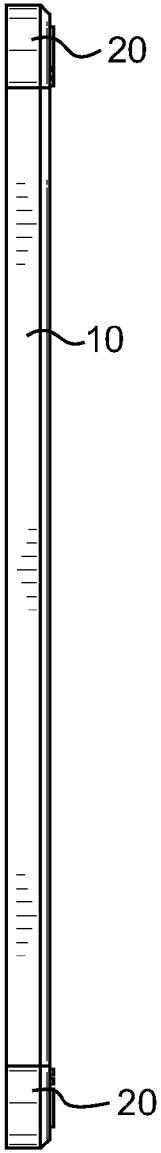
FIG. 5 is a schematic diagram illustrating a side view of the display board of FIG. 1 opposite to the side view shown in FIG. 4.
Figure 4:
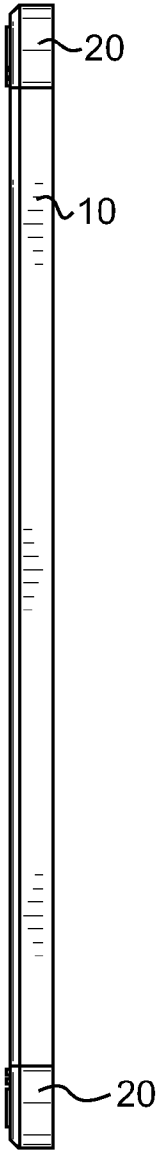
FIG. 4 is a schematic diagram illustrating a side view of the display board of FIG. 1.
Figure 6:
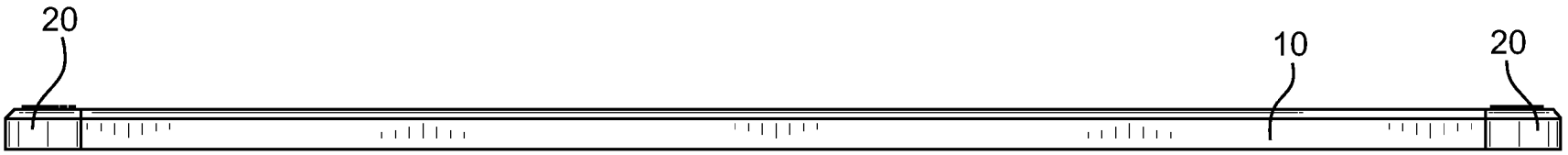
FIG. 6 is a schematic diagram illustrating a top plan view of the display board of FIG. 1.
Figure 7:
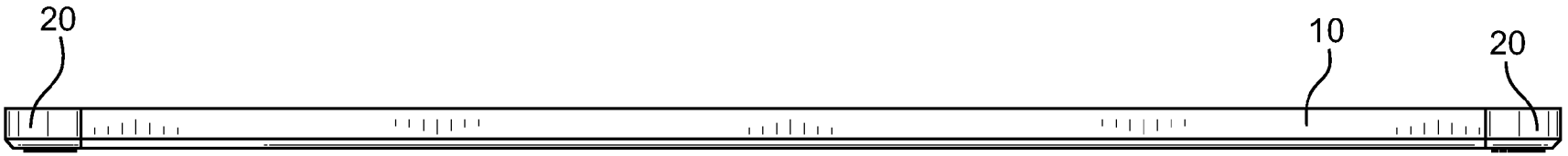
FIG. 7 is a schematic diagram illustrating a bottom plan view of the display board of FIG. 1.

Embodiments of the present invention are directed to features of a display board that may be used separately or in combination. As shown in FIG. 1, embodiments of a display board 60 may include an erasable surface 70 and a frame 10 that surrounds the periphery of the display board and is secured thereto. As used herein, an "erasable surface" means a surface that may receive a compatible medium and then allow the compatible medium to be erased or otherwise removed. An erasable surface may also be referred to as a "write-on/wipe-off surface." As an example, an erasable surface may be a dry erase surface that may receive dry erase ink from a dry erase marker, and then allow the dry erase ink to be removed by wiping the surface with a cloth or paper towel or a dry erase eraser. As another example, an erasable surface may a wet erase surface that may receive wet erase ink from a wet erase marker. The erasable surface 70 and frame 10 may be made of conventional materials. For example, the erasable surface 70 may be a laminate that includes a substrate panel and a semi-transparent or transparent sheet secured to the substrate panel and configured to provide a write-on/wipe-off surface. The substrate panel may provide a background appearance for a writing surface, for example, providing a white surface. The background appearance of the substrate panel may be provided by a sheet of material, a layer of paint, or another suitable layer or coating.

A display board 60 can be constructed out of any material, such as paper, plastic, wood, or metal. A month grid 75 with weekday names and any additional message or writing areas 78 may be printed on the front surface of the substrate panel. Display window and control button openings may be cut out from the substrate panel. A transparent plastic layer may be added to the front of the substrate panel by lamination or by fixing a clear, write-on/wipe-off surface onto a front surface of the substrate panel. Optionally, the month grid 75 may be printed on the transparent plastic layer instead of or in addition to the substrate panel.

By providing a transparent plastic layer with a write-on/wipe-off surface as the erasable surface, the "write-on/wipe-off surface" may be capable of receiving and displaying ink from, for example, a wet or dry erase marker and enabling the ink to be erased when a wet or dry cloth, respectively, is wiped across it. The erasable surface applied to the substrate panel may preferably be a continuous transparent sheet so that the erasable surface may cover and protect the cut-out windows, such that the electronic displays may be visible through the transparent erasable surface. Alternatively, an erasable surface could be cut out around the displays and applied to the substrate panel. As another alternative, in the case of an erasable surface provided by paint or other like material, the erasable surface could be applied to the front surface of the substrate panel and around any cut outs in the substrate panel. As yet another alternative, an erasable surface may be laminated onto a substrate panel first, and then windows may be cut out of the laminated erasable surface and substrate panel.

The frame 10 may be made of, for example, aluminum, plastic, or wood. The frame 10 may include end caps 20 at each corner to connect frame sections or, as shown in the alternative display board construction of FIG. 2.8, the frame sections may be mitered together. FIGS. 3, 4, 5, 6, and 7 illustrate rear, right, left, bottom, and top views, respectively, of the display board of FIGS. 1 and 2.1, showing the configurations and connections between the sections of frame 10 and the end caps 20.

In one embodiment, a display board may include an electronic perpetual calendar. In this embodiment, shown best in FIGS. 1 and 2.1, a graphic 75 may be printed onto the erasable surface 70. The graphic 75 may include a plurality of cells each representing a calendar day. In the embodiment of FIGS. 1 and 2.1, the graphic 75 represents a month grid comprising a plurality of rows and columns. The month grid 75 may include at least thirty-one cells arranged in rows and columns. Each cell may represent an individual day of a month. Weekday names may be displayed adjacent to each column of the month grid, e.g., directly above each column. Each of the at least thirty-one cells may include in a corner an electronic day display 76 visible through a window cut out of the substrate panel and preferably covered by a transparent erasable surface 70. As noted, the dry erase surface applied to the substrate panel may preferably be transparent so that the dry erase surface may cover the window, with the electronic display visible through the transparent dry erase surface. Alternatively, the dry erase surface may be cut out around the display.

The electronic displays may preferably be digital two-digit light-emitting diode (LED) numerical displays. In addition, a display board 60 may include a year display 73, a month display 74, an electronic display control microprocessor (not visible in FIGS. 1 and 2.1), and a plurality of control buttons 71, 72 for controlling the electronic displays. In the embodiment shown in FIGS. 1 and 2.1, the electronic day displays 76, year display 73, month display 74, and a plurality of control buttons 71, 72 may all be in electronic communication with the electronic display control microprocessor to allow control of the electronic displays using the control buttons as a user interface. Displays 73, 74, 76 may be any suitable electronic display, including liquid crystal displays, cathodoluminescent electrophoresis displays (e.g., e-ink displays), electroluminescent displays, electrochromism displays, photoluminescent displays, electrowetting displays, incandescent displays, and electromechanical modulation displays.

In the example shown, control buttons 71 and 72 may directly control the month display 74 via the microprocessor. In particular, button 71 may cause a display to move up one month (as indicated by the upwardly pointing arrow printed on the erasable surface 70) and control button 72 causes the display to move back one month (as indicated by the downwardly pointing arrow printed on the erasable surface 70). In embodiments, a user may select a desired month and year by pressing button 71 or 72 to move forward or backward through the months and years to arrive at the desired month and year. For example, starting with a displayed month and year, pressing the advance-one-month button 71 twelve times may display the same month and the following year. Alternatively, separate controls may be provided to change the month and year independently. For example, a first set of up and down buttons may be provided to control a month display and a second set of up and down buttons may be provided to control a year display.

The microprocessor may then control the remaining displays to accurately display the correct year in the year window 73 and the appropriate configuration of dates within the electronic day displays 76 of the individual cells. To determine appropriate configuration of dates, the microprocessor may have known electronic perpetual calendar firmware, software, or data stored in memory, as is known, to automatically control the remaining displays to accurately display the correct year and dates in the proper cells. Alternatively, instead of buttons, other embodiments may use different manual controls, such as a spin dial to conveniently scroll to the desired month and year, and corresponding dates.

Though a graphic 75 of a single month grid is depicted on the erasable surface 70 in FIGS. 1 and 2.1, other aspects of the present invention may use a multiple month grid. For example, a board may show three or four months at the same time. In one embodiment, a board may display an immediate past month, a present month, and one or two coming months. In another embodiment, a full year may be shown on a board of sufficient size. The size of the board may provide a practical limit on the number of months that can be displayed practically without diminishing the usability, i.e., larger boards may be needed to show several months on the surface.

In other embodiments, a board may display a daily planner, a weekly planner, or a multiple week planner. These planners may include year, month, and day electronic displays that a user may control daily or weekly to show the correct day or days. A daily, weekly, or multiple week planner may also include hourly displays, if desired.

Naturally other forms of user interfaces may be possible. In addition, the adjustment of the display may be made completely automatic by providing radio clock receiver circuitry (preferably in the microprocessor) that is synchronized by a time code bit stream transmitted by a radio transmitter in communication with a time standard, such as an atomic clock. Such a clock may be synchronized to the time sent by a single transmitter, such as many national or regional time transmitters, or may use multiple transmitters, such as the Global Positioning System. If such clock circuitry is provided, an additional display, for time of day, may also be provided on the display board. The time of day may be provided by the time standard.

Referring again to FIGS. 1 and 2.1, in an embodiment, display board 60 may have a frame that has a tackable surface 30 integrated therein. A tackable surface 30 may be constructed of materials such as cork, foam, fiber, or a composite. As shown in FIGS. 1 and 2.1, the tackable surface 30 may be provided along a single edge (preferably the lower edge) of the display board 60 or, as shown in FIGS. 2.6, 2.7, and 2.8, along multiple or all edges. As shown in the example of FIG. 2.8, the tackable surface 30 may be continuous and surround the periphery of the write-on/wipe-off surface. As shown in the examples of FIGS. 2.6 and 2.7, the tackable surface 30 may be substantially continuous around the periphery of the write-on/wipe-off surface, with sections connected by end caps 20. Any of the arrangements shown in FIGS. 2.6, 2.7, and 2.8 may be used in combination with the electronic perpetual calendar feature described above.

The tackable surface 30 may be an integral part of the frame 10 that surrounds the periphery of the write-on/wipe-off surface. In embodiments, the tackable surface 30 may sit within a channel formed in a frame, such that, when viewed in a cross-section, the tackable surface 30 is supported on three sides (bottom surface and side surfaces) by the frame 10. One surface may be exposed so as to provide a tackable surface 30 that permits a note paper or other item to be attached to the board by a push pin or thumb tack, and preferably the pin or tack may be removed to permit mounting of another note paper or item. By integrating the tackable surface 30 into the frame, a desired functionality may be provided in a way that does not require any sacrifice of write-on/wipe-off surface area. Thus, it is possible to maximize useable write-on/wipe-off surface and, if desired, to provide an electronic perpetual calendar on the write-on/wipe-off surface without sacrificing the size of the write-on/wipe-off surface of the calendar or requiring an increase in the size of the board. Since it may be desirable to produce display boards in standard sizes, the space saving aspects of the integrated tackable surface 30 described herein may be highly advantageous.

In addition, providing an integrated tackable surface 30 along the edges, especially the bottom edge, may be advantageous because note papers and other items are commonly attached to a board with a single push pin or thumb tack. A note paper or other item attached to the board by a single push pin or thumb tack may hang down from the pin or tack and cover anything below it. By providing an integrated tackable surface 30 along the edges, especially the bottom edge, interference with the write-on/wipe-off surface area may be minimized.

FIG. 2.2 illustrates a cross-sectional view taken along line 2.2 of FIG. 2.1, showing an embodiment of a construction of a frame 10 that has an integrated tackable surface 30. As shown, the frame 10 may include a channel 11 for securing a board 70 and a channel 12 for receiving and supporting the tackable surface 30. Frame 10 may be extruded and/or cut from metal, plastic, or wood. In the embodiment shown, the tackable surface 30 may be a composite of a surface layer 14 on a supporting layer 33. Since supporting layer 33 may be concealed from view within frame 10 and underneath surface layer 14, supporting layer 33 may be a less expensive tackable material such as extruded or expanded polystyrene foam, while the surface layer 14 may be a more attractive layer such as a cork or fabric layer. As shown in FIG. 2.2, one or more overhanging portions 16 of the frame 10 may overhang one or more portions of the supporting layer 33, to help retain the supporting layer 33 within the channel 12 of frame 10.

Other embodiments may provide alternative configurations of a frame with a tackable surface. For example, FIG. 2.3 shows a cross-sectional view of a frame 10 that has an integrated homogeneous tackable surface 30. As shown, the frame 10 may include a channel 11 for securing a board 70 and a channel 12 for receiving and supporting the tackable surface 30. Frame 10 may be extruded and/or cut from metal, plastic, or wood. In the embodiment shown, since the tackable surface 30 may be homogeneous, the tackable surface 30 may be made of an attractive material such as cork.

FIG. 2.4 shows a cross-sectional view of another embodiment of a frame 10 that has an integrated tackable surface 30. In comparison to the embodiment of FIG. 2.2, the embodiment of FIG. 2.4 has a tackable surface 30 with a wider upper surface and a frame channel that does not overhang any portion of the tackable surface 30. As shown, the frame 10 may include a channel 11 for securing a board 70 and a channel 12 for receiving and supporting the tackable surface 30. Frame 10 may be extruded and/or cut from metal, plastic, or wood. In the embodiment shown, the tackable surface 30 may be a composite of a surface layer 14 on a supporting layer 33. Since supporting layer 33 may be concealed from view within frame 10 and underneath surface layer 14, the supporting layer 33 may be a less expensive tackable material such as extruded or expanded polystyrene foam, while the surface layer 14 may be a more attractive layer such as a cork or fabric layer. As shown, frame 10 does not overhang any portion of the supporting layer 33.

FIG. 2.5 shows a cross-sectional view of another embodiment of a frame 10 that has an integrated tackable surface 30. In comparison to the embodiment of FIG. 2.3, the embodiment of FIG. 2.5 provides a shallower channel in which the tackable surface 30 is disposed. As shown, the frame 10 includes a channel 11 for securing a board 70 and a channel 12 for receiving and supporting the tackable surface 30. Frame 10 may be extruded and/or cut from metal, plastic, or wood. In the embodiment shown, since the tackable surface 30 may be homogeneous, the tackable surface may be made of an attractive material such as cork. To compensate for the shallower channel 12, frame 10 may include a stand-off support member 15 to, for example, increase the width of the frame and space the board farther apart from a wall on which the display board is mounted. The support member 15 may be located on a rear side of the frame as shown in FIG. 2.5, for example, extending in a direction opposite to the direction in which the channel 12 opens. The shallower channel 12 may reduce the volume of tackable surface material needed to fill the channel 12, providing a more economical construction. In one embodiment, as shown in FIG. 2.5, the bottom interior surface of the channel 12 may be substantially aligned with the rear interior surface of the channel 11.

The configurations and features of FIGS. 2.2-2.5 may be interchanged. For example, referring to FIG. 2.2, a homogeneous tackable surface may be provided within the frame 10 instead of the multiple layer tackable surface 30 shown in the figure. Likewise, referring to FIG. 2.5, a multiple layer tackable surface may be provided within the frame instead of the homogeneous tackable surface 30 shown in the figure. In addition, in the embodiments of FIGS. 2.2-2.5, a tackable surface 30 may be further secured to the channel 12 of the frame 10 with an adhesive.

Figure 8:
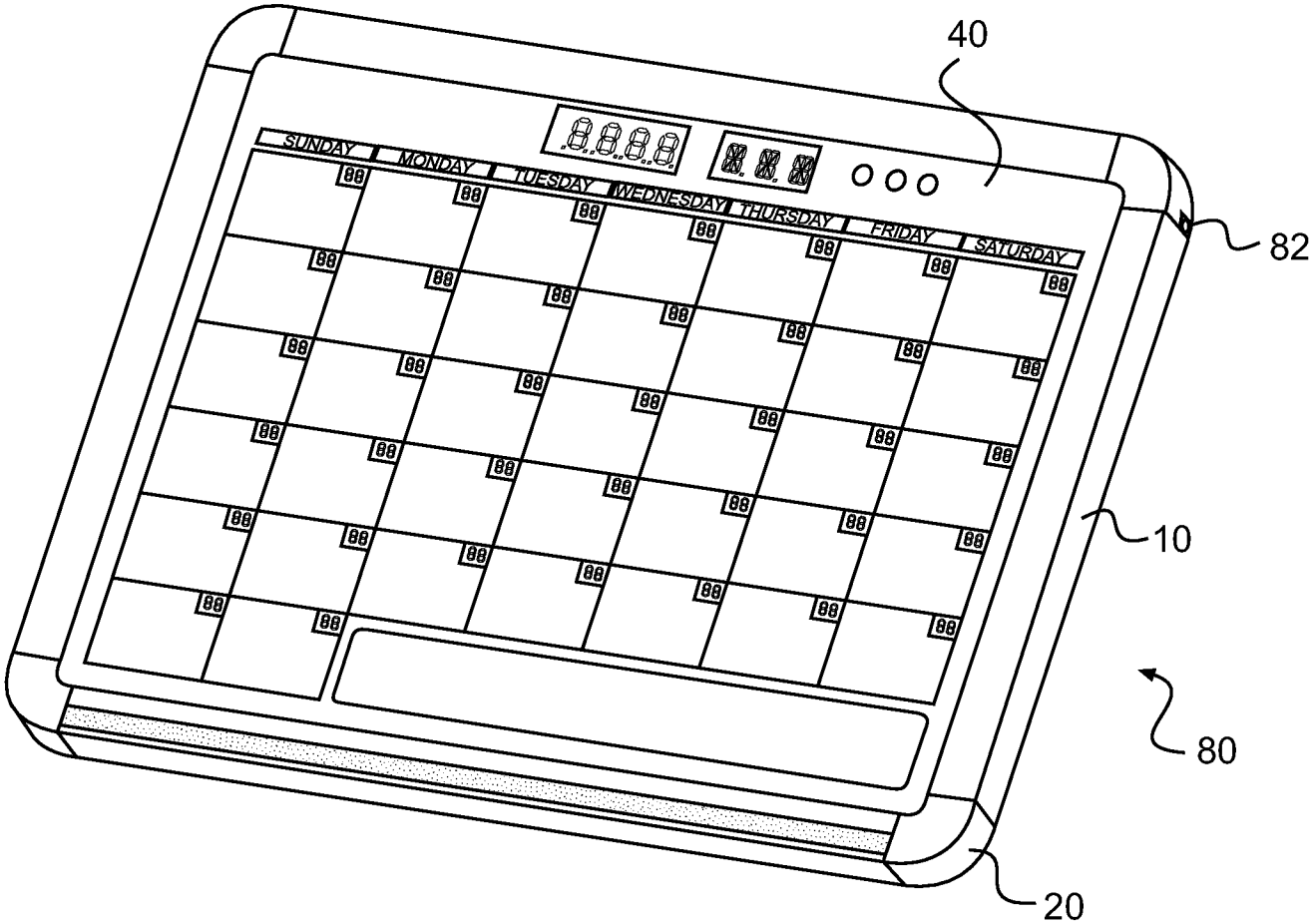
FIG. 8 is a schematic diagram illustrating a front perspective view of another embodiment of a display board.
Figure 9:
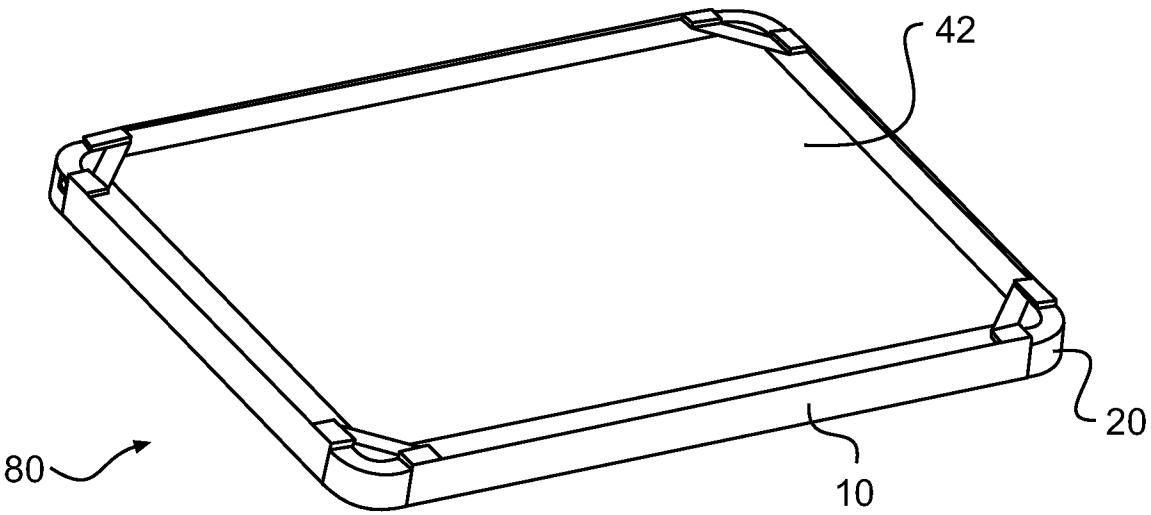
FIG. 9 is a schematic diagram illustrating a back perspective view of the display board of FIG. 8.

FIGS. 8-12 depict another embodiment of a display board 80, to show additional aspects of the present invention. In particular, FIG. 8 illustrates a front perspective view of an embodiment of a display board 80, showing a possible location of a DC adapter port 82. A cord of a power supply may plug into the DC adapter port to provide electrical power to the display control microprocessor. The port 82 may be provided in any other suitable location on the board 80, including a rear surface of the board 80 to conceal the port from view when the board 80 is in use.

As also shown in FIG. 8, the display board 80 may include a frame 10, end caps 20, and a front panel 40. As shown best in the exploded views of FIGS. 11 and 12, the end caps 20 may be disposed at each corner of the board 80 to connect the frame sections 86. The end caps 20 may include a corner member 88 and a bracket 90. The corner member 88 may include male plugs 92 configured to be received within the channels 94 of the frame sections 86, to provide a secure male-female interference fit. The bracket 90 may be provided on the rear side of the corner member 88 to furnish additional structural support. The bracket 90 may include posts 96 that snap into corresponding openings in the corner member 88. Alternatively, a frame section 86 and mating corner member 88 may have aligned openings through which a post 96 of the bracket 90 is secured, to retain the male plug 92 of the corner member 88 within the channel 94 of a frame section 86.

Embodiments may include provisions for containing the electronic components of the perpetual calendar within a display board. As shown in the rear perspective of FIG. 9, a display board 80 may include a back panel 42 in addition to the front panel 40. The front panel 40 and back panel 42 may define a space within the frame 10 in which to hold and protect the electronic components.

FIG. 10.1 is a side view of display board 80 showing depth between the front panel 40 and back panel 42. FIG. 10.2 illustrates a partial cross-sectional view of an embodiment of a configuration between a frame 46, front panel 40, and back panel 42. As shown, the front panel 40 and back panel 42 may be disposed within a channel 11 of the frame 46, and may be separated from each other to define an open space 44. Although not shown in FIG. 10.2, a display board 80 may include one or more spacer members between front panel 40 and back panel 42 to keep the panels separated to define the open space 44. Alternatively or in addition to spacer members, the electronic components of the calendar may also serve to keep the panels 40, 42 separated.

In a representative implementation, referring to FIG. 10.2, a front panel may have a thickness 54 of approximately 3 mm and the back panel 42 may have a thickness 56 of approximately 6 mm. The channel 11 of the frame 10 may define an opening width of approximately 29 mm wide, such that the panels 40, 42 may be separated by a distance 58 of approximately 20 mm. As also shown in FIG. 10.2, the channel 94 of frame 46, which may be configured to receive a portion of an end cap, may have a width 48 of approximately 35 mm and a height 50 of approximately 17 mm. The channel 11 may have members that overlap the panels 40, 42 a distance 52 of approximately 12 mm.

Figure 11:
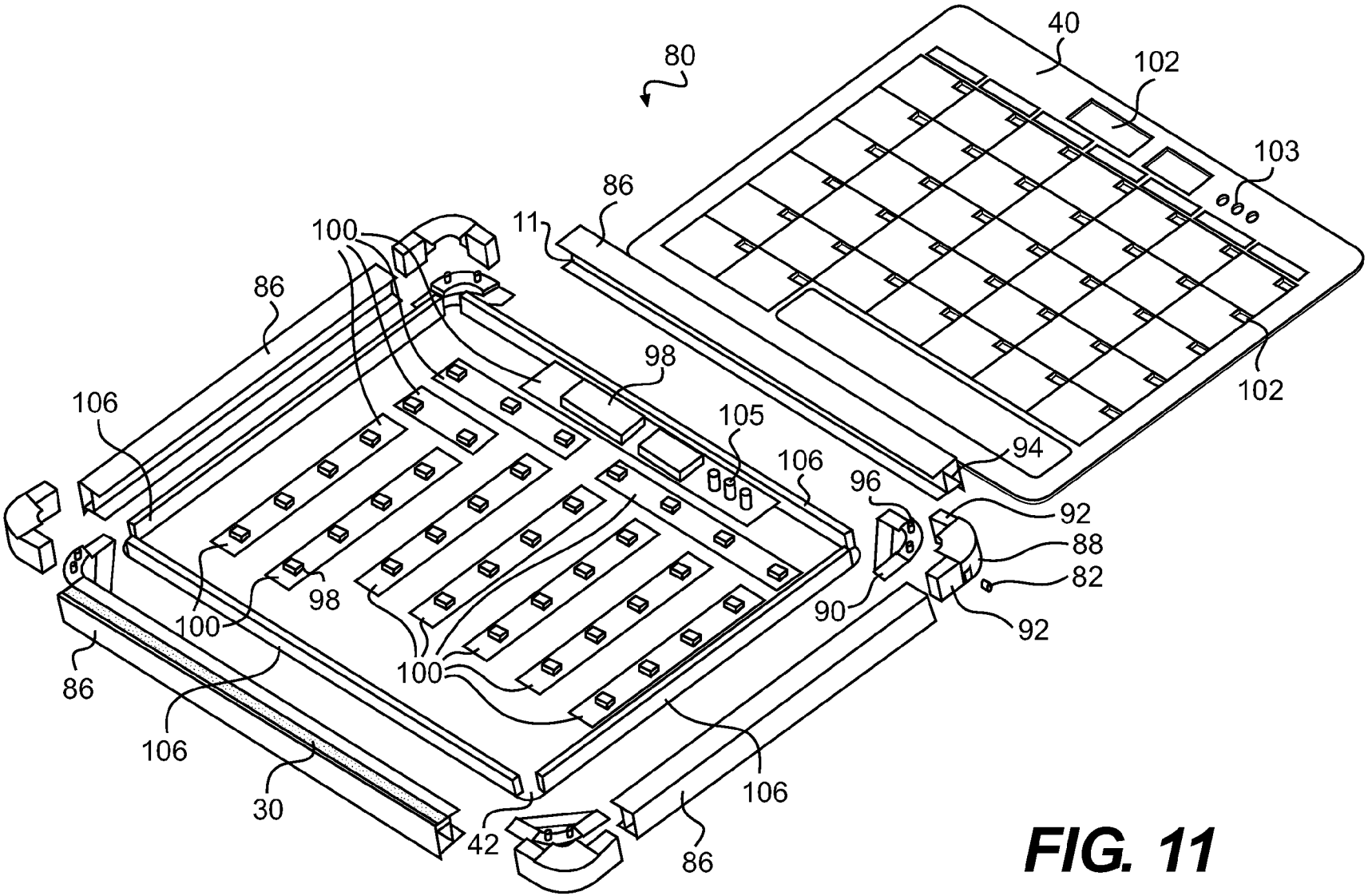
FIG. 11 is a schematic diagram illustrating an exploded front perspective view of the display board of FIG. 8, showing an internal printed circuit board.

FIG. 11 illustrates an exploded front perspective view of the board 80 of FIG. 8, which shows an exemplary arrangement of electronic date displays 98 on multiple printed circuit boards (PCBs) 100 to display the dates. The spacing between push button tubes and electronic control, electronic control and positive printing plate and transparent window locations are shown. The printed circuit boards 100 may be mounted on a common board and/or on the back panel 42 as shown. When assembled, the electronic date displays 98 may align with windows 102 cut out of the front panel 42. The windows 102 may be open or may be covered with a transparent erasable surface layer, as discussed above. Cut outs 103 may also be provided in the front panel 40 to receive the push buttons 105 that control the display microprocessor.

The front panel 40 and the back panel 42, with the electronic components disposed in between, may be disposed in the channels 11 of the frame sections 86. To provide additional structural support and maintain separation between panels 40, 42, as mentioned above, a board may also include spacer members 106 between the panels 40, 42. The spacer members 106 may be disposed along the peripheries of the panels, and within the channels 11. One or more of the frame sections 86 may include a tackable surface 30 as discussed above.

Figure 12:
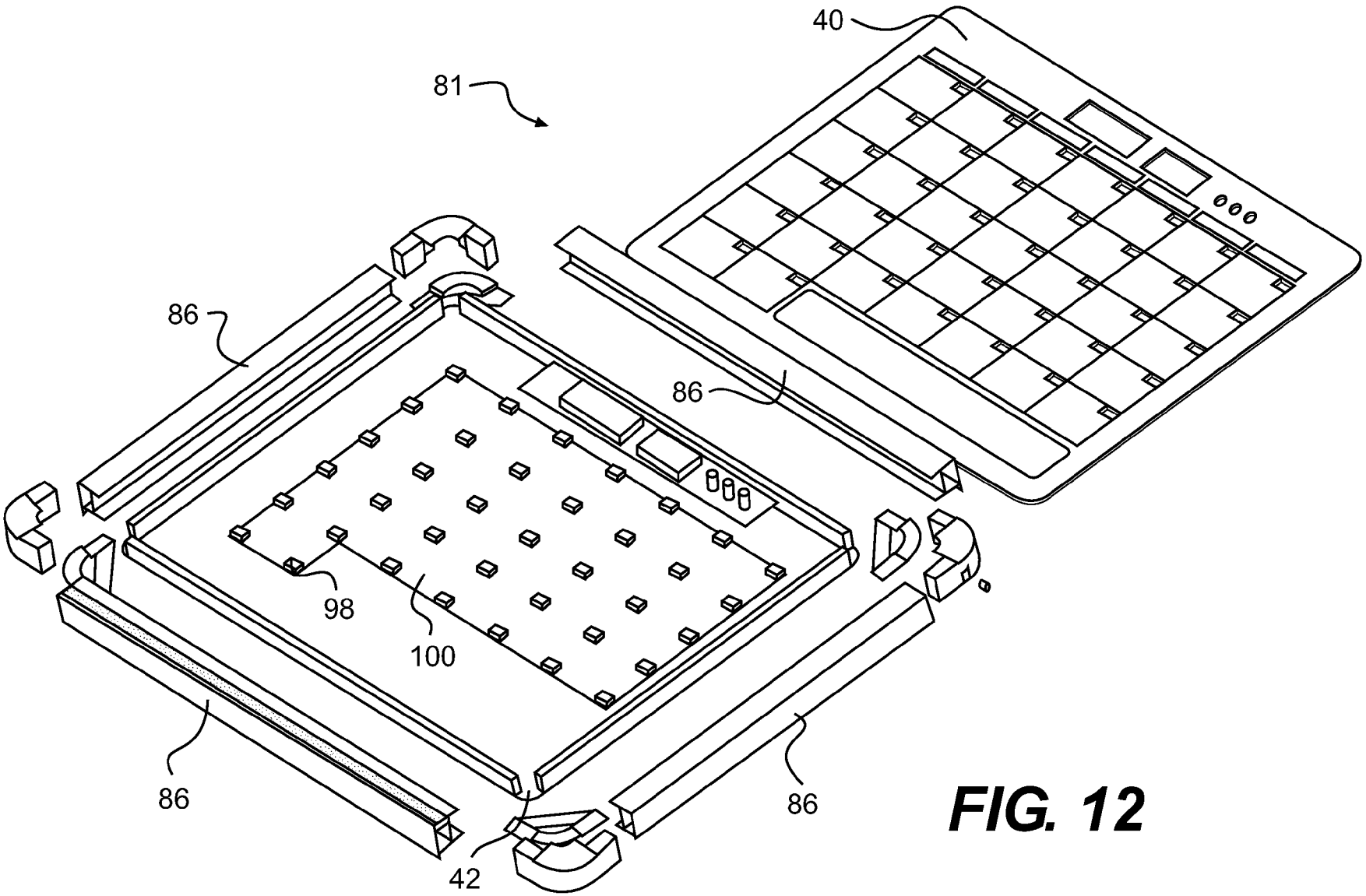
FIG. 12 is a schematic diagram illustrating an exploded front perspective view of the display board of FIG. 8, showing an alternative internal printed circuit board.

FIG. 12 illustrates an exploded front view of an alternative display board 81 where the arrangement of electronic date displays is on a larger printed circuit board 100. The spacing between push button tubes and electronic control, electronic control and positive printing plate and transparent window locations are shown.

Naturally more electronic displays may be needed if a multiple month grid is to be displayed, so that a board may show three or four months (immediate past month, present month, and one or two coming months) at the same time.

Figure 13:
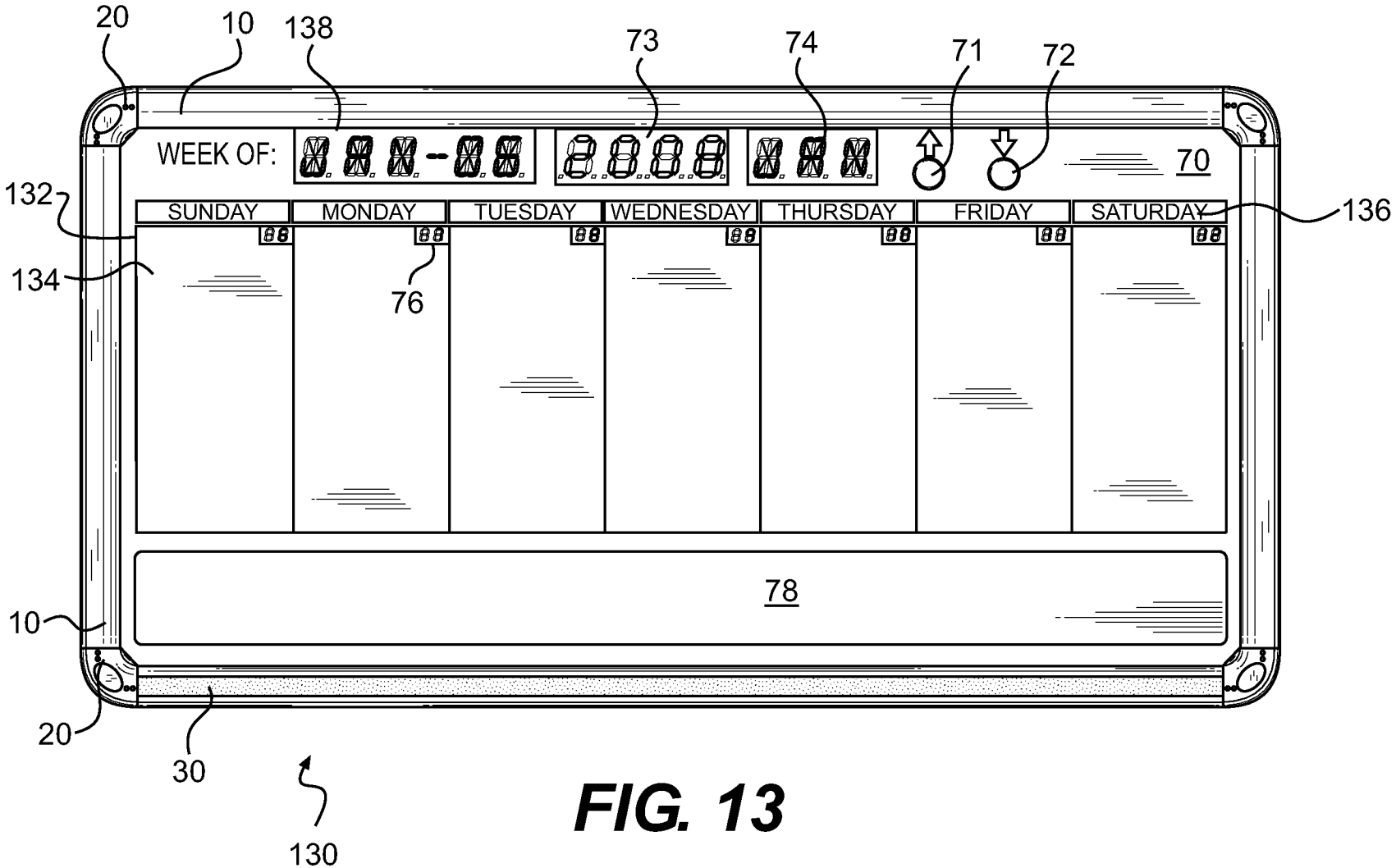
FIG. 13 is a schematic diagram illustrating another embodiment of a display board, which accommodates weekly planning.

As mentioned above, embodiments may also include provisions for displaying calendar configurations other than monthly configurations. For example, a board may display a daily planner, a weekly planner, or a multiple week planner. As an example of these alternative embodiments, FIG. 13 illustrates a display board 130 displaying a graphic 132 of a weekly planner table. As shown, display board 130 may include an electronic perpetual calendar having a weekly planner table 132 permanently printed on the display board. The display board 130 may also have an erasable surface 70, as described above. The weekly planner table 132 may comprise a plurality of cells 134 successively arranged adjacent to each other and a weekday name 136 displayed adjacent to each cell 134. The display board 130 may comprise an electronic day display 76 provided in an area (e.g., a corner) of each cell 134 in a window, a year display 73 for displaying a year, a month display 74 for displaying a month, an electronic display control microprocessor in communication with each of the displays so as to control the displays, and an interface for controlling the electronic displays. The interface may include buttons 71 and 72, which may control the displays via the microprocessor, as described above in reference to FIGS. 1 and 2.1, except that the buttons may move the display forward and backward by week instead of by month. The microprocessor may control the electronic day displays to display the days as appropriate for a selected week. The microprocessor may also control the month and year displays to change the month and year as appropriate for a selected week. Display board 130 may also include additional message or writing areas 78, and may include frame 10, end caps 20, and a tackable surface 30, as also described above in reference to FIGS. 1 and 2.1.

To accommodate weekly planning, display board 130 may also include provisions for labeling the particular week being displayed on the board 130. As shown in FIG. 13, for example, a board 130 may include an electronic week display 138, which may be labeled with the indicia "Week of:" as shown. The electronic week display 138 may display, for example, the month and day of the first day in a selected week, e.g., "Jan-06," representing the sixth day of January in the year displayed in the year display 73. The electronic week display 138 may display consecutive weeks as a user presses the buttons 71 and 72. When a button 71 or 72 is pressed, the microprocessor may control the electronic displays 73, 74, 76, and 138 to display the corresponding days, week, month, and year of a selected week. For example, for the week of Sunday, Jan. 6, 2008, the year display 73 may show "2008," the month display may show "JAN," the date displays 76 may show number six through twelve, and the week display 130 may show "JAN-06." Alternative configurations of week, day, and year displays may be possible. For example, a weekly planner display board may simply display the month and day of a selected week. As another alternative, a weekly planner display board may show the month, day, and year of a selected week, for example, with reference to FIG. 13, including only displays 138 and 73, and excluding display 74.

According to further aspects of the present invention, the electronic perpetual calendar of the present invention may be useful in other contexts. Though embodiments are depicted with frames, a frame may not be necessary. The electronic calendar regardless can have other surfaces, attachments, frame styles, no frame, etc. An example of another embodiment may be a combination board that is an electronic calendar on one side and cork on the other side. Such a board would be useful as a divider, for example.

The power supply to the board could be DC power (battery or AC transformer) and, according to another aspect of the present invention, power may be supplied by photovoltaic or solar cells. The electronic displays may be liquid crystal displays (LCD), LED, or any other electronic display.

Although the foregoing describes the invention in terms of embodiments, the embodiments are not intended to limit the scope of the claims. Rather, the claims are intended to cover all modifications and alternative constructions falling within the spirit and scope of the invention, and are limited only by the plain meaning of the words as used in the claims. In particular, the features described herein may be used separately or in any possible combination.

While various embodiments of the invention have been described, the description is intended to be exemplary, rather than limiting, and it will be apparent to those of ordinary skill in the art that many more embodiments and implementations are possible that are within the scope of the invention. Accordingly, the invention is not to be restricted except in light of the claims and their equivalents. Also, various modifications and changes may be made within the scope of the claims.

Further, in describing representative embodiments of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention.

What is claimed is:

1. A display board comprising an erasable surface, a frame that surrounds the periphery of a display board panel and is secured thereto, and an electronic perpetual calendar, the electronic perpetual calendar comprising:

a graphic permanently printed on the display board, the graphic comprising a plurality of cells each representing a calendar day;

an electronic day display provided in an area of each cell in a window of the display board panel, such that the electronic day display is visible from a front side of the display board;

a year display for displaying a year;

a month display for displaying a month;

an electronic display control microprocessor in communication with each of the electronic day displays so as to control the electronic day displays; and an interface for controlling the electronic day displays, wherein the electronic display control microprocessor controls the electronic day displays to display a configuration of dates corresponding to a designated month and year.

2. The display board of claim 1, wherein the graphic comprises a month grid with the plurality of cells arranged in rows and columns.

3. The display board of claim 1, wherein the graphic comprises a weekly planner table with the plurality of cells arranged in a row, and wherein the electronic display control microprocessor controls the electronic day displays to display a configuration of dates corresponding to a designated month, week, and year.

4. The display board of claim 3, wherein the interface is configured to enable a user to select the designated week, and wherein the electronic perpetual calendar further comprises a week display for displaying the designated week.

5. The display board of claim 1, wherein the year display and the month display are electronic and the interface is configured to control the day, month, and year displays.

6. The display board of claim 1, wherein the electronic day displays are digital two-digit light-emitting diode numerical displays.

7. The display board of claim 1, wherein the interface for controlling the electronic day displays comprises a manual control configured to enable a user to select the designated month and year, and wherein the electronic display control microprocessor automatically controls the electronic day displays to accurately display in the plurality of cells the configuration of dates corresponding to the designated month and year.

8. The display board of claim 7, wherein the interface for controlling the electronic day displays comprises a plurality of control buttons that directly control the month display via the microprocessor, and wherein the electronic display control microprocessor automatically controls the year and day displays to display the designated year in the year display and to accurately display in the plurality of cells the configuration of dates corresponding to the designated month and year.

9. The display board of claim 1, wherein the interface for controlling the electronic day displays is an automatic interface, wherein the display board includes radio clock receiver circuitry that is synchronized by a time code bit stream transmitted by a radio transmitter in communication with a time standard, and wherein the time standard provides the designated month and year.

10. The display board of claim 9, further comprising an additional display for time of day provided by the time standard.

11. The display board of claim 1, wherein the frame has a separate tackable surface integrated therein.

12. The display board of claim 11, wherein the tackable surface is a composite of a surface layer on a supporting layer.

13. The display board of claim 1, wherein the frame has a separate tackable surface integrated therein along a plurality of sides of the frame.

14. The display board of claim 1, wherein the frame has a separate tackable surface integrated therein along all sides of the frame.

15. The display board of claim 1, wherein the display board panel comprises a front panel and a back panel, wherein the frame defines a channel opening towards an interior area defined by the frame, wherein the front panel is disposed within the channel on a front side of the frame, wherein the back panel is disposed within the channel on a back side of the frame such that the front panel and the back panel define an open space in between the front panel and the back panel, wherein the electronic display control microprocessor is disposed within the open space, wherein the erasable surface is disposed on an outer surface of the front panel and the front panel has cut-outs defining the windows of the cells, and wherein the electronic day displays are aligned with the cut-outs of the front panel.

16. The display board of claim 15, wherein the erasable surface comprises a continuous transparent layer over the front panel and the cut-outs of the front panel.

17. The display board of claim 16, wherein the graphic is printed on a substrate surface of the front panel underneath the transparent layer.

18. The display board of claim 15, wherein the frame defines a second channel that opens towards a front side of the display board, wherein a tackable surface is disposed within the second channel, wherein the frame is made of a first material, and wherein the tackable surface is made of a second material different from the first material.

19. The display board of claim 18, wherein the tackable surface comprises an exposed surface layer and a supporting layer concealed within the second channel and underneath the exposed surface layer.

20. The display board of claim 18, wherein the frame defines an overhanging portion that overhangs at least a portion of the tackable surface that is within the second channel.

21. The display board of claim 1, wherein the frame defines a first channel that opens towards an interior area defined by the frame, wherein the frame defines a second channel that opens towards a front side of the display board, wherein the display board panel is disposed within the first channel, wherein a tackable surface is disposed within the second channel, wherein the frame is made of a first material, wherein the tackable material is made of a second material different from the first material, and wherein, when viewed in a cross-section taken along a longitudinal direction of a member of the frame:

a rear interior surface of the first channel is approximately aligned with a bottom interior surface of the second channel, and the frame includes a support member extending toward a rear side of the display panel and generally perpendicularly to the bottom interior surface of the second channel, so as to reduce a volume of the second material needed to fill the second channel.

22. The display board of claim 1, wherein the graphic further comprises a weekday name displayed adjacent to each group of the plurality of cells representing a same weekday.

23. A display board comprising:

a panel;

an erasable surface disposed on the panel, the erasable surface comprising a write-on/wipe-off surface;

a frame that surrounds the periphery of the panel and is secured thereto, the frame having a tackable surface integrated therein;

an electronic perpetual calendar comprising:

a graphic permanently printed on the display board, the graphic comprising a plurality of cells each representing a calendar day, an electronic day display provided in an area of each cell in a window of the panel, such that the electronic day display is visible from a front side of the display board, a year display for displaying a year, a month display for displaying a month, an electronic display control microprocessor in communication with each of the electronic day displays so as to control the electronic day displays, and an interface for controlling the electronic day displays, wherein the electronic display control microprocessor controls the electronic day displays to display a configuration of dates corresponding to a designated month and year.

24. The display board of claim 23, wherein the frame has a tackable surface integrated therein along a plurality of sides of the frame.

25. The display board of claim 23, wherein the tackable surface is a composite of a surface layer on a supporting layer.

26. The display board of claim 23, wherein the tackable surface sits within a channel formed in a member of the frame such that, when viewed in a cross-section taken perpendicular to a longitudinal direction of the frame member, the tackable surface is supported on three sides by the frame and one surface is exposed so as to provide a tackable surface that permits a note paper to be attached to the display board by a push pin or thumb tack.

27. A display board comprising:

a panel;

an erasable surface disposed on the panel, the erasable surface comprising a write-on/wipe-off surface;

a frame that surrounds the periphery of the panel and is secured thereto, the frame having a tackable surface integrated therein, wherein the frame includes a first channel for securing the panel and a second channel for receiving and supporting the tackable surface; and an electronic perpetual calendar that includes:

a month grid permanently printed on the display board, wherein the month grid comprises a plurality of cells arranged in rows and columns and a weekday name displayed adjacent to each column of the month grid, an electronic day display provided in an area of each cell in a window, a year display for displaying a year, a month display for displaying a month, an electronic display control microprocessor in communication with each of the electronic day displays so as to control the electronic day displays, and an interface for controlling the electronic day displays, wherein the electronic display control microprocessor controls the electronic day displays to display a configuration of dates corresponding to a designated month and year.

28. The display board of claim 27, wherein a frame member of the frame, when viewed in a cross-section taken perpendicular to a longitudinal direction of the frame member, defines the first channel having a first opening facing in a first planar direction and the second channel having a second opening facing in a second planar direction substantially perpendicular to the first planar direction, wherein the panel is disposed in the first channel and extends out of the first channel in the first planar direction, wherein the tackable surface is disposed in the second channel and is exposed through the second opening, wherein the tackable surface, when viewed in the cross-section taken perpendicular to the longitudinal direction of the frame member, is supported on three sides by the second channel of the frame member, with one surface of the tackable surface exposed so as to provide a tackable surface that permits a note paper to be attached to the display board by a push pin or thumb tack.

29. The display board of claim 28, wherein the second channel of the frame member, when viewed in the cross-section taken perpendicular to the longitudinal direction of the frame member, has an overhanging portion that extends generally parallel to the first planar direction and overhangs at least a portion of the tackable surface that is disposed in the second channel.

30. A display board comprising:

a panel;

an erasable surface disposed on the panel, the erasable surface comprising a write-on/wipe-off surface;

a frame that surrounds the periphery of the panel and is secured thereto, the frame having a tackable surface integrated therein, wherein the frame includes a first channel for securing the panel and a second channel for receiving and supporting the tackable surface; and an electronic perpetual calendar that includes:

a weekly planner table permanently printed on the display board, wherein the weekly planner table comprises a plurality of cells successively arranged adjacent to each other and a weekday name displayed adjacent to each cell, an electronic day display provided in an area of each cell in a window, a year display for displaying a year, a month display for displaying a month, an electronic display control microprocessor in communication with each of the electronic day displays so as to control the electronic day displays, and an interface for controlling the electronic day displays, wherein the electronic display control microprocessor controls the electronic day displays to display a configuration of dates corresponding to a designated month, week, and year.

* * * * *